United States Patent [19]

Tiefenbach, Jr. et al.

[11] Patent Number: 4,867,759

[45] Date of Patent: Sep. 19, 1989

[54] BINDER FOR ABRASIVE GREENWARE

[75] Inventors: Lawrence W. Tiefenbach, Jr., Traverse City; James E. Schuetz; Thomas T. Chiu, both of Midland, all of Mich.

[73] Assignee: The Dow Chemical Company, Midland, Mich.

[21] Appl. No.: 136,213

[22] Filed: Dec. 18, 1987

[51] Int. Cl.[4] ..... C09K 3/14

[52] U.S. Cl. ..... 51/298; 264/63

[58] Field of Search ..... 264/63; 51/298

[56] References Cited

U.S. PATENT DOCUMENTS

| | | | |
|---|---|---|---|
| 1,364,849 | 1/1921 | Anderson . | |
| 1,458,376 | 6/1923 | Anderson . | |
| 1,548,145 | 8/1925 | Keever . | |
| 1,548,146 | 8/1925 | Keever . | |
| 1,555,086 | 9/1925 | Tilton et al. . | |
| 1,918,242 | 7/1933 | Benner et al. . | |
| 1,956,905 | 5/1934 | Merriam | 51/280 |
| 2,082,545 | 6/1937 | Ljungberg | 51/278 |
| 2,104,609 | 1/1938 | Leeuw | 51/278 |
| 2,281,526 | 4/1942 | Milligan et al. | 51/308 |
| 2,290,366 | 7/1942 | Benner et al. | 106/39 |
| 2,293,099 | 8/1942 | Barnes et al. | 25/156 |
| 2,309,463 | 1/1943 | Lombard et al. | 51/293 |
| 2,312,392 | 3/1943 | Daniels | 51/298 |
| 2,361,784 | 10/1944 | Melton et al. . | |
| 2,423,293 | 7/1947 | Ciell . | |
| 2,534,128 | 12/1950 | Howe | 51/304 |
| 2,534,129 | 12/1950 | Howe | 51/305 |
| 4,474,928 | 10/1984 | Hoenig | 525/186 |
| 4,525,495 | 6/1985 | Dorman et al. | 523/205 |
| 4,623,688 | 11/1986 | Flanagan | 524/377 |
| 4,634,720 | 1/1987 | Dorman et al. | 521/63 |
| 4,636,526 | 1/1987 | Dorman et al. | 521/61 |
| 4,661,536 | 4/1987 | Dorman et al. | 523/113 |
| 4,662,897 | 5/1987 | Atkinson et al. | 51/293 |

OTHER PUBLICATIONS

Developmental Polymer XAS-10874 Poly(Ethyloxazoline), Form No. 171-010-84, Dow Chemical Company.

Don Tucker, "Abrasive and Bond Systems-and Their Uses", The 1986-1987 AES Reference & Buyers' Guide, pp. 16-26.

Chemical Abstracts 93:52508m.

Chemical Abstracts 106:87077j.

Chemical Abstracts 106:142887a.

Chemical Abstracts 106:142686j.

*Primary Examiner*—James Derrington

*Attorney, Agent, or Firm*—P. D. Hayhurst; D. R. Howard

[57] ABSTRACT

Abrasive greenware having improved strenght is prepared using a binder comprising poly(ethyloxazoline).

16 Claims, No Drawings

BINDER FOR ABRASIVE GREENWARE

BACKGROUND OF THE INVENTION

The present invention relates to ceramic greenware, particularly greenware which can be fired into abrasive articles.

Abrasive articles such as sharpening stones, honing stones, mold stones, dressing sticks, grinding wheels, and microfinishing stones are useful in polishing, sharpening, dressing, shaping and the like. For example, an Arkansas stone can be used to sharpen knives Arkansas stones can be prepared synthetically, or, as indicated by the name, can be cut from natural stone. Synthetic Arkansas stones and other synthetic abrasive articles are prepared by firing the appropriate greenware. The greenware is prepared by cold pressing a mixture comprising abrasive particles, a temporary binder and vitreous bond components. Without the binder the greenware would lose its shape or fall apart upon removal from the cold pressing mold. The strength of the greenware, i.e. green strength, needs to be high enough to prevent damage to the greenware during firing and handling. For example, during transfer from the press to the firing furnace greenware of insufficient strength can be deformed resulting in, e.g. chipped edges or finger marks.

Following cold pressing, the greenware is fired. The purpose of firing is to decompose the binder and melt the vitreous bond component of the greenware. A binder commonly employed in the abrasive industry is dextrin. This dextrin is added to the pregreenware batch as a fine powder and is mixed with the abrasive grit and bond components. When making small articles using what is referred to as "press to size" technology it is common to use large amounts of dextrin. This is especially true for fine grain (e.g. 400 grit) materials with high (e.g. 10) grit to bond ratios. This large amount of dextrin is required to provide sufficient green strength. Large amounts of dextrin require long burn off times to ensure complete removal of the dextrin. Incomplete removal of dextrin leaves carbonaceous residue in the greenware. This residue leads to bubbles and imperfections, such as bloating, upon firing.

In view of the disadvantages associated with dextrin, it would be advantageous to have a readily removable temporary binder for abrasive greenware. It also would be advantageous if this binder could be employed in lower amounts than dextrin to give equal or greater green strength, and if it could be used with shorter binder burn out cycles, thereby improving productivity.

SUMMARY OF THE INVENTION

The present invention employs poly(ethyloxazoline) as such a binder in the preparation of abrasive greenware. The invention includes a process for preparing abrasive greenware by pressing a mixture comprising an abrasive material, poly(ethyloxazoline), and a vitreous bond material to form an abrasive greenware article. Surprisingly, in comparison with dextrin, much less poly(ethyloxazoline) is required to form greenware of sufficient strength. The use of poly(ethyloxazoline) is further advantageous in that it readily mixes with the abrasive formulation, it reduces the tendency for greenware to stick to the pressing dies and molds, and it requires less time to "burn out" than does dextrin. These advantages result in significant economic benefits. For example, the productivity of the cold pressing operation is increased due to the high strength of the greenware and its reduced tendency to stick to the dies. Additionally, shorter burn out time results in increased furnace turn around time and, therefore, greater furnace productivity.

DETAILED DESCRIPTION OF THE INVENTION

The process of the present invention requires an abrasive material, a vitreous bond material, poly(ethyloxazoline), and optionally, a carrier medium.

The poly(ethyloxazoline) is employed in an amount sufficient to provide a green ceramic article with enough strength to retain its shape during normal handling and processing. Preferably the ceramic greenware comprises between about 0.1 and about 20 weight percent poly(ethyloxazoline) and more preferably between about 0.1 and about 10 weight percent based on the weight of the ceramic material. Even more preferably, said greenware comprises between about 0.2 and about 5 weight percent of poly(ethyloxazoline), and most preferably from about 0.5 to about 3.0 weight percent. The poly(ethyloxazoline) preferably has a weight average molecular weight ranging from about 1,000 to about 1,000,000 and more preferably from about 50,000 to about 500,000.

An abrasive material is employed in the process of the present invention. This abrasive material typically is granular and commonly is referred to as grit. While virtually any size grit can be employed, common grit sizes range from submicron size to in excess of 1 mm. The grit forms the bulk of the abrasive article to be produced. Any abrasive material can be employed as the grit. Preferably, the abrasive material comprises ceramic material such as metal oxides, carbides and nitrides. Examples of preferred abrasive materials include alumina, silicon carbide, diamond, silica, boron carbide, tungsten carbide, titanium carbide, cubic boron nitride, aluminum nitride and the like. Alumina and silicon carbide are examples of more preferred abrasive materials.

The abrasive grit is held together in the final article by a vitreous bond material, also called the "permanent" bond. The vitreous bond material is employed in an amount which is sufficient to maintain the integrity of the finished abrasive article. The use of vitreous bonds is well known in the art. For example, see U.S. Pat. Nos. 1,364,849: 1,548,145; 2,281,526; and 2,423,293, the teachings of which, with respect to bonds, are incorporated herein by reference. Preferably, the bond comprises a powdered glass frit and, optionally, a clay, which preferably is a ball clay. Preferably, for the sake of convenience, the glass has a low softening point. For example, a preferred glass frit has a softening point ranging from about 500° C. to about 600° C. Aluminum borosilicate glasses are more preferred. Preferably, from about 0.05 to about 1 part of vitreous bond material is employed per part of abrasive material. More preferably, from about 0.1 to about 0.5 part of vitreous bond material is employed per part of abrasive material. The clay typically is employed in an amount which ranges between about zero and about 40 weight percent of the total vitreous bond material. It is preferred to employ from about 0.1 to about 0.4 part of ball clay per part of glass.

The grit, the bond, and the poly(ethyloxazoline) are mixed together using well known methods. For example, molten poly(ethyloxazoline) can be added to a previously formed mixture of grit and bond with stirring or blending until the grit and bond particles are thoroughly wetted. A more preferred method of mixing the grit, bond, and binder involves the use of a carrier medium. The carrier medium serves to suspend the solid grit and bond particles, and further serves to disperse the poly(ethyloxazoline) binder in a manner such that the solid particles of grit and bond are thoroughly wetted. Preferably, the carrier medium is substantially capable of dissolving poly(ethyloxazoline). Examples of preferred carrier media include water, acetone, methanol, ethanol, other polar organic solvents, and the like, and mixtures thereof. Water is the most preferred carrier medium in view of its ease of use, and in view of the fact that poly(ethyloxazoline) is water soluble. However, polar organic solvents, such as methanol, ethanol and acetone, are particularly useful in this invention if it is desired to avoid the chemical reactions that may occur if the ceramic grit is in the presence of water. For example, nitrides may form oxides in the presence of water, and this may or may not be desired.

As is well known in the art, other optional materials, such as lubricants, coloring agents, surfactants, dispersants, fillers, such as sawdust, and the like can be added to the mixture of grit, bond, and binder. For example, a lubricant can be employed in order to reduce the friction between particles during cold pressing. Examples of lubricants include, for example, calcium stearate, zinc stearate, synthetic waxes, stearic acid, and the like. Coloring agents can be employed for the purpose of altering the color of the final article. Examples of coloring agents include ceramic pigments and glass enamels, e.g. colored glazes. Advantageously, the greenware of the present invention does not require biodegradable polymers, such as alpha amino acid polymers, and can be prepared in the absence of such polymers.

The mixed material can be formed into greenware by known methods such as, for example, casting, cold pressing or extrusion. As is well known, cold pressing can be dry, semi-dry, isostatic, and the like. The resulting greenware is a porous article. The greenware must have sufficient strength to be handled without breakage or significant deformation. For example, greenware has insufficient strength when picking it up with the bare hand in a normal fashion would leave finger indentations or rounded or chipped edges.

The greenware is fired using methods well known in the art. The purpose of firing is to remove the temporary binder and to convert the bond material into a glassy phase that will form the permanent bond between the abrasive particles. Complete removal of the temporary binder, i.e. poly(ethyloxazoline), is desirable. Incomplete removal of the temporary binder can have consequences such as leaving carbon residue that can later be trapped in the vitreous bond material, causing bubbles which lead to bloating, warping, cracking and the like.

Poly(ethyloxazoline) can decompose rapidly if heated above certain temperatures, such as about 600° F. (316° C.) unless it is slowly heated to reach said temperatures. Rapid decomposition produces large volumes of gas which can crack the greenware. Thus, it is preferred to perform the binder burn out step at a temperature below about 460° F. (238° C.) for a time sufficient to remove slowly most of these gases before the temperature is increased to the next step of the firing sequence.

The fired abrasive articles typically are very porous. Abrasive articles can be made with varying degrees of porosity and cohesion, as is well known to those skilled in the art. The articles can be prepared with sharp, well defined edges in view of the improved strength of the greenware.

SPECIFIC EMBODIMENTS OF THE INVENTION

The following examples and comparative experiments are included for illustrative purposes only, and are not intended to limit the scope of the invention. All parts and percentages are by weight unless otherwise indicated.

EXAMPLE 1

An aqueous solution of poly(ethyloxazoline) having a weight average molecular weight of about 200,000, is prepared by adding 30 weight parts poly(ethyloxazoline) into 70 parts water. A high speed/high shear mixer is employed. Mixing is continued until the poly(ethyloxazoline) is dissolved.

The solution (5.4 parts) is added to a vessel containing 30.3 parts of 100 mesh mined novaculite. The resulting mixture is blended vigorously for about 8 minutes to ensure that the grit is thoroughly wetted with the solution. Then 10.1 parts of 200 mesh novaculite are added to the wetted mass and the resulting mixture is blended for about 5 minutes at a slower speed to ensure that the grit is thoroughly wetted.

Calcium stearate (1.2 parts) is added as a lubricant to 13.9 parts of a finely ground (<320 mesh) aluminum borosilicate fritted glass powder. The lubricant and the glass powder are blended and then added to the vessel and the resulting mixture is blended for about 5 minutes.

Eight parts of Tennessee ball clay are added to the vessel and the contents are mied for another 5–10 minutes at a lower mixing speed. At this point, the appearance of the mixture is similar to that of damp sand.

The mixture is then sieved through a 20-mesh screen to remove large particles. The screened powder is then dried in air until the moisture content is approximately 1 weight percent. The strength of the greenware can be detrimentally affected if the powder is too dry. On the other hand, a powder with an excessive moisture content will not have good flow characteristics and may result in an abrasive article having non-uniform density.

The powder is then passed through a 40-mesh screen, and is ready to be formed into greenware. The powder is cold pressed at 2500 psi into blocks having the following dimensions: $\frac{1}{2}'' \times 1\frac{5}{8}'' \times 6''$. The modulus of rupture (flexural strength) of the greenware is measured using a 3-point bend test, and is determined to be 102 psi.

A number of greenware blocks are placed on edge on a refractory batt. The batt is then placed in a kiln and is subjected to the following firing schedule:

| | | |
|---|---|---|
| 200° F. | for 1 hour | for drying |
| 200° F.–460° F. | in 1 hour | get to burnoff plateau |
| 460° F. | for 6 hours | low temp. burnoff |
| 460° F.–900° F. | in 3 hours | get to burnoff plateau |
| 900° F. | for 2 hours | high temp. burnoff |
| 900° F.–1900° F. | in 4.5 hours | to reach vitrification temp. |

Hold at vitrification temperature for 2 hours.

The kiln and the abrasive articles are allowed to cool. The cooled articles are uniform in appearance and have well defined edges. The articles have a porosity of 34.5 volume percent and a density of 1.80 g/cm$^3$.

COMPARATIVE EXPERIMENT 1

(not an embodiment of the present invention)

The procedure of Example 1 is repeated except that dextrin is employed rather than poly(ethyloxazoline). The modulus of rupture of the greenware is determined to be 59 psi.

EXAMPLE 2

An aqueous solution of poly(ethyloxazoline), having a weight average molecular weight of about 200,000, is prepared by adding 45 weight parts poly(ethyoxazoline) granules into 55 parts water. A high speed/high shear mixer is employed. Mixing is continued until the poly(ethyoxazoline) is dissolved.

The solution (3.6 parts) is added to a vessel containing 25.1 parts of 180 mesh fused alumina. The resulting mixture is blended vigorously for about 6 minutes to ensure that the grit is thoroughly wetted with the solution. Then 25.1 parts of 200 mesh fused alumina are added to the wetted mass and the resulting mixture is blended for about 5 minutes at a slower speed to ensure that the grit is thoroughly wetted. A finely ground (<320 mesh) aluminum borosilicate fritted glass powder (9.4 parts) is then added to the vessel and the resulting mixture is blended for about 5 minutes.

Tennessee ball clay (3.8 parts) is added to the vessel and the contents are mixed for another 5–10 minutes at a lower mixing speed. At this point, the appearance of the mixture is similar to that of damp sand. The mixture is then sieved through a 20-mesh screen to remove large particles. The screened powder is then dried in air until the moisture content is approximately 1 weight percent. The powder is then passed through a 40-mesh screen, and is ready to be formed into greenware. The powder is cold pressed into blocks at a pressure (ca. 2800 psi) that gives a green density of 2.17 g/cm$^3$. The blocks have the following dimensions: $\frac{1}{4}'' \times 2'' \times 7''$. The modulus of rupture of the greenware is measured using a 3-point bend test, and is determined to be 446 psi.

A number of greenware blocks are stacked flat on a refractory batt. The batt is then placed in a kiln and is subjected to the firing schedule of Example 1. The kiln and the abrasive articles are allowed to cool. The cooled articles are uniform in appearance and have well defined edges. The articles have a porosity of 42.0 volume percent and a density of 2.08 g/cm$^3$.

COMPARATIVE EXPERIMENT 2

(not an embodiment of the present invention)

The procedure of Example 2 is repeated except that dextrin is employed rather than poly(ethyloxazoline). The modulus rupture of the greenware is determined to be 114 psi.

The preceding Examples and Comparative Experiments demonstrate the unexpectedly improved green strength of greenware prepared using poly(ethyloxazoline) versus dextrin as a binder. The following additional observations are applicable to the preparation of greenware in the Examples and Comparative Experiments: compared to greenware prepared using poly(ethyloxazoline), greenware prepared using dextrin has weak edges, is dusty during cold pressing, and is fragile and easily broken during normal handling.

What is claimed is:

1. A process for producing an abrasive greenware article having improved strength, the process comprising:

(a) preparing a mixture of an abrasive grit, a vitreous bond and a binder comprising poly(ethyloxazoline); and (b) forming the mixture into an article of abrasive greenware.

2. The abrasive greenware article produced according to the process of claim 1.

3. The article of claim 2 wherein the abrasive comprises at least one of diamond, cubic boron nitride, silica, silicon carbide or alumina.

4. The process of claim 1 wherein step a) comprises mixing, per 100 weight parts of abrasive (i) from about 0.5 to about 20 weight parts poly(ethyloxazoline);

(ii) from about 1 to about 100 weight parts water;

(iii) from about 5 to about 100 weight parts glass frit;

(iv) optionally from about 0 to about 40 weight parts clay; and (v) optionally from about 0 to about 10 weight parts lubricant.

5. The process of claim 4 wherein the abrasive grit comprises at least one of silica, cubic boron nitride, alumina, silicon carbide or diamond.

6. The process of claim 4 wherein the glass frit comprises an aluminum borosilicate glass.

7. The process of claim 6 wherein a clay is employed.

8. The process of claim 7 wherein the clay comprises ball clay.

9. The process of claim 1 wherein the greenware article is fired to produce a finished abrasive article.

10. The process of claim 1 wherein step (a) comprises mixing, per 100 weight parts of abrasive grit:

(i) from about 1 to about 5 weight parts poly(ethyloxazoline);

(ii) from about 3 to about 15 weight parts water;

(iii) from about 10 to about 45 weight parts glass frit;

(iv) optionally from about 0 to about 15 weight parts clay; and (v) optionally from about 0 to about 5 weight parts lubricant.

11. In a process for producing abrasive greenware by mixing abrasive grit with a binder, a vitreous bond material, and optionally at least one of a clay, water, and a lubricant, and then shaping the resulting mixture into a greenware part, the part having approximately the same dimensions as the fired part produced therefrom, the improvement comprising using poly(ethyloxazoline) as the binder.

12. The process of claim 11 wherein the greenware is prepared by pressing.

13. The process of claim 11 wherein from about 0.5 to about 20 weight parts poly(ethyloxazoline) are employed per 100 weight parts of grit.

14. The process of claim 13 wherein from about 1 to about 5 weight parts poly(ethyloxazoline) are employed per 100 weight parts of grit.

15. The process of claim 11 wherein the bond comprises an aluminum borosilicate glass.

16. The process of claim 15 wherein the clay is ball clay.

* * * * *

UNITED STATES PATENT AND TRADEMARK OFFICE

CERTIFICATE OF CORRECTION

PATENT NO. : 4,867,759

DATED : September 19, 1989

INVENTOR(S) : Lawrence W. Tiefenbach, Jr., James E. Schuetz and Thomas T. Chiu

It is certified that error appears in the above-identified patent and that said Letters Patent is hereby corrected as shown below:

Cover sheet line 1 of Abstract please delete "strenght" and insert -- strength --.

Column 1, line 12 please delete "knives Arkansas" and insert -- knives. Arkansas --.

Column 4, line 38 please delete "mied" and insert -- mixed --.

Column 6, line 18 please delete "abrasive" and insert -- abrasive grit: --.

Signed and Sealed this

Twelfth Day of March, 1991

*Attest:*

HARRY F. MANBECK, JR.

*Attesting Officer*

*Commissioner of Patents and Trademarks*